US009103200B2

(12) United States Patent
Baihly et al.

(10) Patent No.: US 9,103,200 B2
(45) Date of Patent: Aug. 11, 2015

(54) RATE INDUCED DIVERSION FOR MULTI-STAGE STIMULATION

(75) Inventors: Jason Baihly, Katy, TX (US); Kevin W. England, Houston, TX (US); Janice Gregory-Sloan, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 374 days.

(21) Appl. No.: 12/838,834

(22) Filed: Jul. 19, 2010

(65) Prior Publication Data

US 2011/0048719 A1 Mar. 3, 2011

Related U.S. Application Data

(60) Provisional application No. 61/237,145, filed on Aug. 26, 2009.

(51) Int. Cl.
*E21B 43/26* (2006.01)
*E21B 43/16* (2006.01)

(52) U.S. Cl.
CPC ..... *E21B 43/16* (2013.01); *E21B 43/26* (2013.01)

(58) Field of Classification Search
CPC ..... E21B 43/16; E21B 43/26
USPC ..... 166/308.1, 306
See application file for complete search history.

(56) References Cited

U.S. PATENT DOCUMENTS

| | | | | |
|---|---|---|---|---|
| 3,933,205 | A | 1/1976 | Kiel | |
| 5,536,115 | A | 7/1996 | Keck | |
| 5,551,516 | A | 9/1996 | Norman et al. | |
| 5,964,295 | A | 10/1999 | Brown et al. | |
| 5,979,555 | A | 11/1999 | Gadberry et al. | |
| 5,979,557 | A | 11/1999 | Card et al. | |
| 6,140,277 | A | 10/2000 | Tibbles et al. | |
| 6,258,859 | B1 | 7/2001 | Dahayanake et al. | |
| 6,509,301 | B1 | 1/2003 | Vollmer et al. | |
| 2004/0094300 | A1 * | 5/2004 | Sullivan et al. | 166/308.1 |
| 2005/0230117 | A1 * | 10/2005 | Wilkinson | 166/308.1 |
| 2006/0240994 | A1 * | 10/2006 | Eoff et al. | 507/214 |

OTHER PUBLICATIONS

SPE6984—The Kiel Process—Reservoir Stimulation by Dendritic Fracturing—Kiel, O.M. 1977 Society of Petroleum Engineers.
Hewett, "Induced Stress Diversion: A Novel Approach to Fracturing Multiple Pay Sands of the NBU Field, Uintah Co., Utah", SPE 39945, 1998.

* cited by examiner

*Primary Examiner* — Brad Harcourt
(74) *Attorney, Agent, or Firm* — Jeffrey Anderson; Rachel E. Greene; Tim Curington

(57) ABSTRACT

The invention provides a method of stimulation a subterranean formation to improve formation fluid production, the method comprising: providing a wellbore which penetrates the subterranean formation, wherein the wellbore comprises at least two perforation cluster zones; injecting a treatment fluid into the wellbore at a fluid pressure equal to or greater than the fracture initiate pressure of the subterranean formation; contacting the subterranean formation with the treatment fluid through a first perforation cluster zone; performing a shutin by stopping injection of the treatment fluid; waiting for a determined period of time, wherein no physical material is introduced into the wellbore and no significant reverse flow from the subterranean formation to the wellbore occurs during said period of time; resuming the introduction of the treatment fluid into the wellbore at a fluid pressure equal to or greater than the fracture initiate pressure of the subterranean formation; and contacting the subterranean formation with the treatment fluid through a second perforation cluster zone.

21 Claims, 1 Drawing Sheet

RATE INDUCED DIVERSION FOR MULTI-STAGE STIMULATION

CROSS-REFERENCE TO RELATED APPLICATIONS

This application claims the benefit of U.S. Provisional Application No. 61/237,145, filed Aug. 26, 2009, which is incorporated herein by reference in its entirety.

FIELD OF THE INVENTION

This invention relates generally to methods for treating a well penetrating a subterranean formation. More specifically, the invention relates to an improved method for enhancing productivity in multi-stage stimulation.

BACKGROUND

Some statements may merely provide background information related to the present disclosure and may not constitute prior art.

Stimulation treatments, primarily hydraulic fracturing, are required in many types of formations, including shale gas reservoirs in order to obtain commercial production rates and to increase the area of reservoir that can be effectively drained with a wellbore. Wellbores are drilled in most of the gas shale reservoirs today as the standard completion practice as it has been shown that being able to contact more of the reservoir with the wellbore and then hydraulic fracturing along it results in the best rate/recovery/economics compared to vertical wells.

In hydraulic fracture stimulation operations for horizontal wellbores, one goal is to effectively stage alternate pumping sequences in order to get as near complete stimulation coverage as possible. For example, the simplest method of hydraulic fracturing the horizontal wellbore would be to not provide any attempt at isolation/diversion and simply bullhead the treatment fluid at a high rate, in some cases, with the hopes that some of the treatment will go to all parts of the reservoir. This has been shown to be very ineffective based on post-treatment evaluation of the production behavior along the wellbore. One of the most comprehensive approaches would be to isolate and hydraulically fracture stimulate at very small increments along the horizontal wellbore from the toe back to the heel. There are different approaches in between these extremes that may provide the best return on investment for different reservoir conditions.

One multi-stage fracturing technique involves the use of pump-down bridge plugs and perforating guns (see FIG. 1—Prior Art). In this type of multi-stage fracturing, the horizontal wellbore is divided into a number of sections (the number of sections depends on a number of factors such as wellbore length, geomechanical, petrophysical, etc. information on the shale in the horizontal section, shale zone thickness, etc.) to be hydraulically fracture stimulated. In order to make the pumping operations as efficient and less costly to the operator as possible, major time delays are minimized, and pumping is conducted as continuously as possible, but the ability to conduct the operation in this way can differ significantly for different shale reservoirs, clients, etc.

In some operations, for the first fracture stimulation stage of a horizontal wellbore, the perforation clusters are shot with perforating guns in the section nearest the toe of the horizontal wellbore. The hydraulic fracture stimulation is pumped into this section of clustered perforations as per the treatment design. At some point during a flush stage of the treatment, the inlet location of the fluid at the surface will be changed so a bridge plug and perforating gun combo (on wireline or slickline) can be pumped down the wellbore in order to isolate the previous fractured stage, to allow perforation of the next set of clustered perforations, so the next fracture stimulation stage can be performed. After the bridge plug is placed above the section that has just been fracture stimulated, a next set of clusters can be perforated and the perforating gun is extracted from the wellbore via wireline/slickline. The next fracture stimulation stage can be pumped and the process is repeated until the entire horizontal wellbore has been stimulated, as illustrated in FIG. 2—Prior Art. FIG. 2—Prior Art shows result after completion of the fracture stimulation for four sections of the horizontal wherein the perforation clusters for each section and the bridge plugs isolating each lower stage from the subsequent fracture stimulation treatment Within each of these sections shown above in FIG. 2—Prior Art, the clusters of perforations may be shot in the best attempt to effectively stimulate the entire section. Depending on several variables, it may be optimum to provide a means of fluid diversion within the section being fracture stimulated in order to ensure adequate coverage of each of the perforation clusters.

In some cases, perforation clusters are phased perforations shot over a span of about 1 to about 2 ft of the casing in order to maximize opportunities to create separate non-interacting hydraulic fractures. Different techniques of trying to ensure coverage of all of the clustered perforation set includes, but is not limited to, limited entry perforating, use of particulate chemicals, use of perforation ball sealers, use of fiber diversion, as well as any other suitable techniques. The use of different types of diversion depends on wellbore conditions, risk mitigation, formation damage considerations, and the like. Another major consideration is whether or not the fracture stimulation treatment is being monitored in real-time with microseismic. With microseismic monitoring it is possible to infer the perforation clusters that are accepting fluid during the pumping, as well as determining whether diversion during the pumping stage is effective.

The Applicants have found a new way of achieving a reliable diversion technique.

SUMMARY

In a first aspect a method of stimulation a subterranean formation to improve formation fluid production is disclosed. The method comprises providing a wellbore which penetrates the subterranean formation, wherein the wellbore comprises at least two perforation cluster zones; injecting a treatment fluid into the wellbore at a fluid pressure equal to or greater than the fracture initiate pressure of the subterranean formation; contacting the subterranean formation with the treatment fluid through a first perforation cluster zone; performing a shutin by stopping injection of the treatment fluid; waiting for a determined period of time, wherein no physical material is introduced into the wellbore and no significant reverse flow from the subterranean formation to the wellbore occurs during said period of time; resuming the introduction of the treatment fluid into the wellbore at a fluid pressure equal to or greater than the fracture initiate pressure of the subterranean formation; and contacting the subterranean formation with the treatment fluid through a second perforation cluster zone.

In a second aspect, the method comprises providing a wellbore which penetrates the subterranean formation, wherein the wellbore comprises at least two perforation cluster zones; injecting a treatment fluid into the wellbore at a fluid pressure equal to or greater than the fracture initiate pressure of the subterranean formation; contacting the subterranean formation with the treatment fluid through a first perforation cluster zone; performing a slow down regime by reducing the injection of the treatment fluid; waiting for a determined first period of time; subsequently, performing a shutin by stopping injection of the treatment fluid; waiting for a determined second period of time, wherein no physical material is introduced into the wellbore and no significant reverse flow from the subterranean formation to the wellbore occurs during said second period of time; resuming the introduction of the treatment fluid into the wellbore at a fluid pressure equal to or greater than the fracture initiate pressure of the subterranean formation; and contacting the subterranean formation with the treatment fluid through a second perforation cluster zone.

In a last aspect, the method comprises providing a wellbore which penetrates the subterranean formation, wherein the wellbore comprises at least two perforation cluster zones; injecting a treatment fluid into the wellbore at a fluid pressure equal to or greater than the fracture initiate pressure of the subterranean formation; contacting the subterranean formation with the treatment fluid through a first perforation cluster zone; performing a slow down regime for a period of time by reducing the injection of the treatment fluid; monitoring the wellbore to calculate the period of time with a technique as microseismic measurement, surface fluid pressure, downhole fluid pressure, fluid pump rate, surface seismic measurement, surface tiltmeter reading, downhole surface tiltmeter reading, flowmeters, or any combination thereof; resuming the introduction of the treatment fluid into the wellbore at a fluid pressure equal to or greater than the fracture initiate pressure of the subterranean formation; and contacting the subterranean formation with the treatment fluid through a second perforation cluster zone.

DETAILED DESCRIPTION

Figure 1:
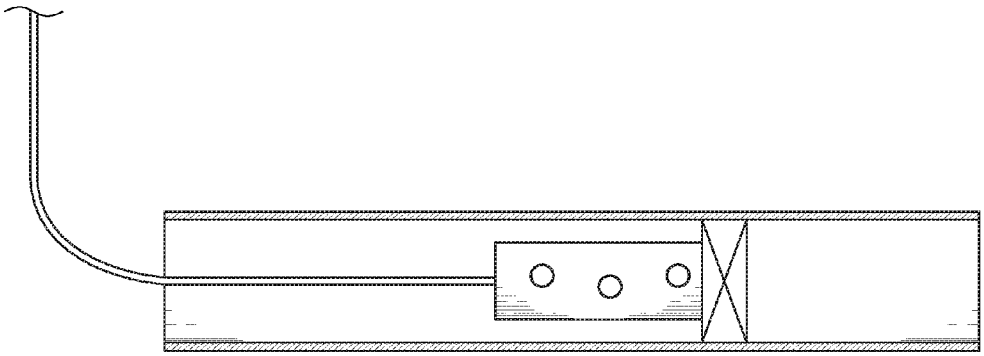
FIG. 1 (Prior Art)
FIG. 1 shows a schematic view of a pump-down bridge plug and perforation gun according to a prior art.
Figure 2:
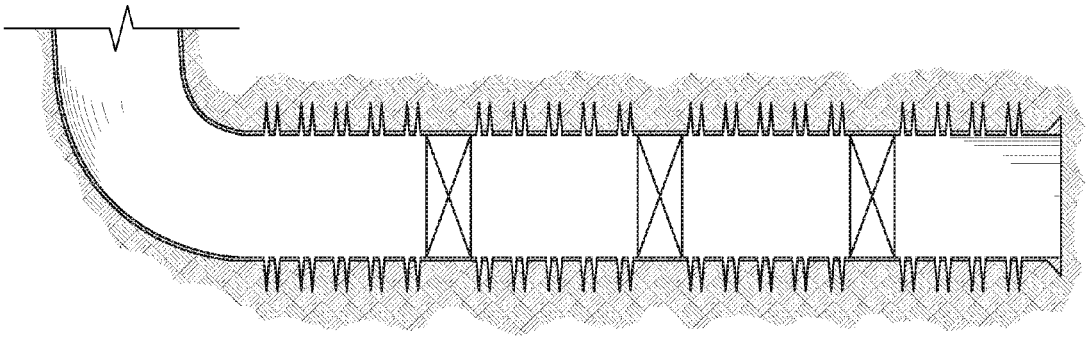
FIG. 2 (Prior Art)
FIG. 2 shows a schematic view of a completion technique according to prior art.

At the outset, it should be noted that in the development of any such actual embodiment, numerous implementation-specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. The description and examples are presented solely for the purpose of illustrating the embodiments of the invention and should not be construed as a limitation to the scope and applicability of the invention. While the compositions of the invention are described herein as comprising certain materials, it should be understood that the composition could optionally comprise two or more chemically different materials. In addition, the composition can also comprise some components other than the ones already cited.

In the summary of the invention and this description, each numerical value should be read once as modified by the term "about" (unless already expressly so modified), and then read again as not so modified unless otherwise indicated in context. Also, in the summary of the invention and this detailed description, it should be understood that a concentration range listed or described as being useful, suitable, or the like, is intended that any and every concentration within the range, including the end points, is to be considered as having been stated. For example, "a range of from 1 to 10" is to be read as indicating each and every possible number along the continuum between about 1 and about 10. Thus, even if specific data points within the range, or even no data points within the range, are explicitly identified or refer to only a few specific data points, it is to be understood that inventors appreciate and understand that any and all data points within the range are to be considered to have been specified, and that inventors have disclosed and enabled the entire range and all points within the range.

The following definitions are provided in order to aid those skilled in the art in understanding the detailed description of the invention.

The term "fracturing" refers to the process and methods of breaking down a geological formation and creating a fracture, i.e. the rock formation around a well bore, by pumping fluid at very high pressures, in order to increase production rates from a hydrocarbon reservoir. The fracturing methods otherwise use conventional techniques known in the art.

The method of the present invention contemplates the formation of multiple hydraulic fractures which extend generally laterally away from a vertical, deviated or horizontal well penetrating a subterranean formation. The fractures are considered to extend generally in a vertical plane or possibly in other directions and in opposite directions from the well.

According to an aspect, the technique disclosed herewith proposes a stimulation treatment isolation/diversion employing only the use of shutting down pumping for a period of time.

The well is equipped with a casing which comprises at least two perforation cluster zones. The wellbore penetrates a subterranean formation. A first perforation cluster zone is localized on the casing and communicates with the subterranean formation. A second perforation cluster zone is localized on the casing and communicates with the subterranean formation. The technique disclosed herewith could also apply in open hole formation.

A treatment fluid is introduced in the cased wellbore at a fluid pressure equal to or greater than the fracture initiate pressure of the subterranean formation. The treatment fluid is injecting through a conventional injection tubing or a coil tubing or any known technique in the art. The injection is made with known pumps and pumping techniques. The injection allows creation of fractures in the formation at the first perforation cluster zone level. According to one embodiment, the treatment fluid used is a conventional fracturing fluid without proppant. According to a further embodiment, the fracturing fluid may further comprise proppant. Examples of treatment fluids will be discussed later.

The injection of the treatment fluid is stopped for a determined period of time, wherein no physical material is introduced into the wellbore and no significant reverse flow from the subterranean formation to the wellbore occurs during said period of time. Said differently no flow back occurs during said period of time. During said time, it is believed the treatment fluid injected in the first perforation cluster zone will create a diverting agent automatically without the need of further diverting agents.

The period of time will be determined by taking into account formation characteristics, observation of external measurements, other indicators, and the like. The period of time may vary from some minutes or less to an hour or even more. In some applications short terms as five minutes, 10 minutes, 30 minutes or an hour are enough. In other application longer times may be required, some couple of hours, as 4 hours. Without being bound to a theory it is believed that after some time no significant changes in diversion technique will occur. If the treatment is used for matrix stimulation a time of 8 hours may be the maximum waiting time, in case of fracturing treatment the maximum time may be of 12 hours.

In accordance with the invention, the well is not commercially produced between injections; this distinguishes the method from simple retreatment of a well and from a double cycle occurring accidentally due to mechanical breakdown in the course of a conventional treatment. Also, in accordance with the invention, the discontinuance of fluid injection in the course of the double cycle is intentional, which further distinguishes such a double cycle from that occurring accidentally due to mechanical breakdown. The period of injection interruption will, of course, normally be much less than the period of commercial production of a well between repeated conventional treatments, which period would be a matter of months or years. The interruption of injection occurring during a double cycle may therefore be characterized as scheduled and brief, thereby to distinguish it from accidental interruptions and from the case of retreatment after commercial production.

The introduction of the treatment fluid into the wellbore at a fluid pressure equal to or greater than the fracture initiate pressure of the subterranean formation is resumed and diversion from the first perforation cluster zone is realized. Thereafter, the injection allows creation of fractures in the formation at the second perforation cluster zone level.

The methods may be useful in vertical, horizontal, or highly deviated wellbores. In vertical wellbores with multiple sets of perforated intervals open, using a process known in the industry as Induced Stress Diversion (ISD), a fracture stimulation treatment stage is pumped into a wellbore with multiple open perforated intervals. At the completion of each pumping stage, the pump rate is lowered in order to induce a screenout mode in the interval being stimulated. If a screenout is not obtained the well will be flowed back immediately upon treatment shutdown in order to create a "reverse screenout". Sometimes a "reverse screenout" is the preferred method without the attempt of an induced screenout, especially in very low permeability reservoirs and when there is minimum distance between the separate zones being fracture-stimulated. This results in a significant increase in the "effective" pressure in the interval causing a subsequent un-stimulated interval to be fracture stimulated. This process can be repeated until some or all of the perforated intervals have been stimulated. In some cases the treatment may be shutdown for a period to allow the fracture to close a little more on the proppant-pack, which can result in increased resistance against subsequent pumping sequences, so as to make sure the placed proppant-pack is not displaced. Some aspects of the concept of Induced Stress Diversion are found in SPE Paper number 39945, titled "Induced Stress Diversion: A Novel Approach to Fracturing Multiple Pay Sands of the NBU Field, Uintah Co., Utah", which is incorporated herein by reference thereto.

According to a further aspect, the shutin can be replaced, preceded or followed by a slow down regime for a second period of time. In this slow down regime, the injection rate will be reduced of 50%, 60%, 70%, 80%, 90%, 95% or even more.

The second period of time will be determined by taking into account formation characteristics, observation of external measurements, other indicators, and the like. The second period of time may vary from some minutes or less to an hour or even more. In some applications short terms as five minutes, 10 minutes, 30 minutes or an hour are enough. In other application longer times may be required, some couple of hours, as 4 hours.

Any suitable fluid type or chemistry may be used in embodiments of the invention, as the inventors contemplate no fluid type nor chemistry would application/practice of the embodiments as described.

In some embodiments, the treatment fluid may comprise a viscosifying agent, as for example a polymer viscosifying agent or a viscoelastic surfactant (VES). The polymer viscosifying agent may be hydratable gels (e.g. guars, polysaccharides, xanthan, diutan, hydroxy-ethyl-cellulose, etc.), or a cross-linked hydratable gel. The polymer viscosifying agent may be a crosslinkable polymer and a crosslinking agent capable of crosslinking the polymer.

Embodiments of crosslinkable polymer include, for example, polysaccharides such as substituted galactomannans, such as guar gums, high-molecular weight polysaccharides composed of mannose and galactose sugars, or guar derivatives such as hydroxypropyl guar (HPG), carboxymethylhydroxypropyl guar (CMHPG) and carboxymethyl guar (CMG), hydrophobically modified guars, guar-containing compounds, and synthetic polymers. Crosslinking agents based on boron, titanium, zirconium or aluminum complexes are typically used to increase the effective molecular weight of the polymer and make them better suited for use in high-temperature wells.

Other embodiments of crosslinkable polymer include polyvinyl polymers, polymethacrylamides, cellulose ethers, lignosulfonates, and ammonium, alkali metal, and alkaline earth salts thereof. More specific examples of other polymers are acrylamide polymers and copolymers, acrylic acid-acrylamide copolymers, acrylic acid-methacrylamide copolymers, polyacrylamides, partially hydrolyzed polyacrylamides, partially hydrolyzed polymethacrylamides, polyvinyl alcohol, polyvinyl acetate, polyalkyleneoxides, carboxycelluloses, carboxyalkylhydroxyethyl celluloses, hydroxyethylcellulose, other galactomannans, heteropolysaccharides obtained by the fermentation of starch-derived sugar (e.g., xanthan gum), diutan, and ammonium and alkali metal salts thereof.

Cellulose derivatives are also used in an embodiment, such as hydroxyethylcellulose (HEC) or hydroxypropylcellulose (HPC), carboxymethylhydroxyethylcellulose (CMHEC) and carboxymethycellulose (CMC), with or without crosslinkers. Xanthan, diutan, and scleroglucan, three biopolymers, have been shown to have excellent proppant-suspension ability even though they are more expensive than guar derivatives and therefore have been used less frequently unless they can be used at lower concentrations.

The viscosifying agent may be a viscoelastic surfactant (VES). The useful VES's include cationic, anionic, nonionic, mixed, zwitterionic and amphoteric surfactants, especially betaine zwitterionic viscoelastic surfactant fluid systems or amidoamine oxide viscoelastic surfactant fluid systems. Examples of suitable VES systems include those described in U.S. Pat. Nos. 5,551,516; 5,964,295; 5,979,555; 5,979,557; 6,140,277; 6,258,859 and 6,509,301, which are all hereby incorporated by reference. The system of the invention is also useful when used with several types of zwitterionic surfactants. In general, suitable zwitterionic surfactants have the formula:

$$RCONH—(CH_2)_a(CH_2CH_2O)_m(CH_2)_b—N^+(CH_3)_2—(CH_2)_{a'}(CH_2CH_2O)_{m'}(CH_2)_{b'}COO^-$$

in which R is an alkyl group that contains from about 11 to about 23 carbon atoms which may be branched or straight chained and which may be saturated or unsaturated; a, b, a', and b' are each from 0 to 10 and m and m' are each from 0 to 13; a and b are each 1 or 2 if m is not 0 and (a+b) is from 2 to about 10 if m is 0; a' and b' are each 1 or 2 when m' is not 0 and (a'+b') is from 1 to about 5 if m is 0; (m+m') is from 0 to about 14; and the 0 in either or both $CH_2CH_2O$ groups or chains, if present, may be located on the end towards or away from the quaternary nitrogen. One embodiment of surfactants is betaines In some embodiments, the treatment fluid may further comprise a breaker selected from the group consisting of oxidative breakers, enzymes, pH modifiers, metal chelators, metal complexors, polymer hydrolysis enhancers, and micelle disturbing substances.

In some embodiments, it may be desired to foam or energize the treatment fluid using a gas, such as air, nitrogen, carbon dioxide, or combined. The treatment fluid may therefore further comprise a foaming agent to increase its tendency to foam. A foaming agent is usually a surfactant that, typically present in small amounts, facilitates the formation of a foam, or enhances its stability by inhibiting the coalescence of bubbles.

The treatment fluid may further comprise proppant materials. The selection of a proppant involves many compromises imposed by economical and practical considerations. Criteria for selecting the proppant type, size, and concentration is based on the needed dimensionless conductivity, and can be selected by a skilled artisan. Such proppants can be natural or synthetic (including but not limited to glass beads, ceramic beads, sand, and bauxite), coated, or contain chemicals; more than one can be used sequentially or in mixtures of different sizes or different materials. The proppant may be resin coated, or pre-cured resin coated, provided that the resin and any other chemicals that might be released from the coating or come in contact with the other chemicals of the Invention are compatible with them. Proppants and gravels in the same or different wells or treatments can be the same material and/or the same size as one another and the term "proppant" is intended to include gravel in this discussion. In general the proppant used will have an average particle size of from about 0.15 mm to about 2.39 mm (about 8 to about 100 U.S. mesh), more particularly, but not limited to 0.25 to 0.43 mm (40/60 mesh), 0.43 to 0.84 mm (20/40 mesh), 0.84 to 1.19 mm (16/20), 0.84 to 1.68 mm (12/20 mesh) and 0.84 to 2.39 mm (8/20 mesh) sized materials. Normally the proppant will be present in the slurry in a concentration of from about 0.12 to about 0.96 kg/L, or from about 0.12 to about 0.72 kg/L, or from about 0.12 to about 0.54 kg/L.

The treatment fluid may also contain other enhancers or additives. Any additives normally used in well treatment fluids can be included, such additives can include, but are not limited to anti-oxidants, crosslinkers, corrosion inhibitors, delay agents, biocides, buffers, fluid loss additives, pH control agents, solid acids, solid acid precursors, etc.

In some embodiments, treated are formations with cased and/or cemented wellbore, with perforated, jetted, and/or slotted clusters. However, embodiments may also include any pumping operations with the goal of obtaining good zonal coverage. The inventive concept may even be useful for matrix treatment applications, as well as hydraulic fracturing. Embodiments also include treatments for oil and gas producing wells, water producing well, CO2 producing wells, any type of injection wells, and the like, and may be used for types of wellbore completions, such as cased (cemented or not cemented), slotted casing/liners, pre-perforated casing/liners, openhole, perforated, jetted (abrasive), and the like.

To facilitate a better understanding of the invention, the following examples of embodiments are given. In no way should the following examples be read to limit, or define, the scope of the invention.

Example

In one exemplary embodiment involving treatment of a horizontal wellbore, a first perforation cluster zone was fracture stimulated, and then the treatment shutdown, and wellbore shutin. Microseismic monitoring was conducted during the first treatment, and continued during the shutdown, which lasted about 3 to about 4 hours. When pumping resumed, the Inventors surprisingly discovered microseismic data indicated that the treatment had diverted from the first treatment zone clusters (those taking the fluid before the shutdown), to a second zone of perforation clusters that were not taking any fluid before the shutdown. This was conducted without delivering any diverting material during the treatments. Formation fluid production from the wellbore where the diversion was achieved by shutin, was described as "phenomenal".

The foregoing disclosure and description of the invention is illustrative and explanatory thereof and it can be readily appreciated by those skilled in the art that various changes in the size, shape and materials, as well as in the details of the illustrated construction or combinations of the elements described herein can be made without departing from the spirit of the invention.

What is claimed is:

1. A method of stimulation a subterranean formation to improve formation fluid production, the method comprising:

a. providing a wellbore which penetrates the subterranean formation, wherein the wellbore comprises at least two perforation cluster zones;

b. injecting a treatment fluid into the wellbore at a fluid pressure equal to or greater than the fracture initiate pressure of the subterranean formation;

c. contacting the subterranean formation with the treatment fluid through a first perforation cluster zone;

d. performing a shutin by stopping injection of the treatment fluid;

e. waiting for a determined period of time, wherein no physical material is introduced into the wellbore and no significant reverse flow from the subterranean formation to the wellbore occurs during said period of time;

f. resuming the introduction of the treatment fluid into the wellbore at a fluid pressure equal to or greater than the fracture initiate pressure of the subterranean formation, wherein resuming occurs immediately following the determined period of time with no physical material introduced into the wellbore and no significant reverse flow from the subterranean formation to the wellbore; and g. contacting the subterranean formation with the treatment fluid through a second perforation cluster zone as a consequence of the determined period of time; wherein the stimulation is performed without delivering separate diverting material to the wellbore.

2. The method of claim 1 wherein the stimulation is a fracturing treatment of the subterranean formation.

3. The method of claim 2, wherein the period of time is from 5 minutes to 12 hours.

4. The method of claim 3, wherein the period of time is from 1 hour to 4 hours.

5. The method of claim 3, wherein the period of time is from 30 minutes to 1 hour.

6. The method of claim 1 wherein the stimulation is a matrix treatment of the subterranean formation.

7. The method of claim 6, wherein the period of time is from 5 minutes to 8 hours.

8. The method of claim 7, wherein the period of time is from 1 hour to 2 hours.

9. The method of claim 7, wherein the period of time is from 10 minutes to 1 hour.

10. The method of claim 1, further comprising the step of monitoring the wellbore to calculate the period of time.

11. The method of claim 10, wherein calculation of the period of time is done with microseismic measurement, surface fluid pressure, downhole fluid pressure, fluid pump rate, surface seismic measurement, surface tiltmeter reading, downhole surface tiltmeter reading, flowmeters, or any combination thereof.

12. The method of claim 1, wherein the treatment fluid is selected from the group consisting of slickwater, viscosified aqueous fluid, acid, gelled oil, foam, or energized fluid.

13. The method of claim 1, wherein the treatment fluid is comprises at least one of nitrogen, $CO_2$, or air.

14. The method of claim 1, wherein the portion of the formation in communication with the first perforation cluster zone is not effectively treated while contacting the subterranean formation with treatment fluid through a second perforation cluster zone.

15. The method of claim 1, wherein the portion of the formation in communication with the first perforation cluster zone is at least partially treated while contacting the subterranean formation with treatment fluid through a second perforation cluster zone.

16. The method of claim 1, wherein the portion of the formation in communication with the first perforation cluster zone is simultaneously treated while contacting the subterranean formation with treatment fluid through a second perforation cluster zone.

17. The method of claim 1, further comprising the step of performing a slow down regime by reducing injection of the treatment fluid.

18. A method of stimulation a subterranean formation to improve formation fluid production, the method comprising:

a. providing a wellbore which penetrates the subterranean formation, wherein the wellbore comprises at least two perforation cluster zones;

b. injecting a treatment fluid into the wellbore at a fluid pressure equal to or greater than the fracture initiate pressure of the subterranean formation;

c. contacting the subterranean formation with the treatment fluid through a first perforation cluster zone;

d. performing a slow down regime by reducing the injection of the treatment fluid;

e. waiting for a determined first period of time;

f. subsequently, performing a shutin by stopping injection of the treatment fluid;

g. waiting for a determined second period of time, wherein no physical material is introduced into the wellbore and no significant reverse flow from the subterranean formation to the wellbore occurs during said second period of time;

h. resuming the introduction of the treatment fluid into the wellbore at a fluid pressure equal to or greater than the fracture initiate pressure of the subterranean formation, wherein resuming occurs immediately following the determined second period of time with no physical material introduced into the wellbore and no significant reverse flow from the subterranean formation to the wellbore; and i. contacting the subterranean formation with the treatment fluid through a second perforation cluster zone as a consequence of the determined first period of time and the determined second period of time; wherein the stimulation is performed without delivering separate diverting material to the wellbore.

19. The method of claim 18, wherein the first period of time is from 1 minute to 2 hours.

20. The method of claim 18, wherein the second period of time is from 5 minutes to 12 hours.

21. A method of stimulation a subterranean formation to improve formation fluid production, the method comprising:

a. providing a wellbore which penetrates the subterranean formation, wherein the wellbore comprises at least two perforation cluster zones;

b. injecting a treatment fluid into the wellbore at a fluid pressure equal to or greater than the fracture initiate pressure of the subterranean formation;

c. contacting the subterranean formation with the treatment fluid through a first perforation cluster zone;

d. performing a slow down regime for a period of time by reducing the injection of the treatment fluid;

e. monitoring the wellbore to calculate the period of time with a technique as microseismic measurement, surface fluid pressure, downhole fluid pressure, fluid pump rate, surface seismic measurement, surface tiltmeter reading, downhole surface tiltmeter reading, flowmeters, or any combination thereof;

f. resuming the introduction of the treatment fluid into the wellbore at a fluid pressure equal to or greater than the fracture initiate pressure of the subterranean formation, wherein resuming occurs immediately following the period of time during which no physical material is introduced into the wellbore and there is no significant reverse flow from the subterranean formation to the wellbore; and g. contacting the subterranean formation with the treatment fluid through a second perforation cluster zone as a consequence of the period of time; wherein the stimulation is performed without delivering separate diverting material to the wellbore.

* * * * *